US009875596B1

(12) United States Patent
McNeil

(10) Patent No.: US 9,875,596 B1
(45) Date of Patent: Jan. 23, 2018

(54) FISH PROOF FEE COLLECTION DEVICE

(71) Applicant: Randy McNeil, Estes Park, CO (US)

(72) Inventor: Randy McNeil, Estes Park, CO (US)

( * ) Notice: Subject to any disclaimer, the term of this patent is extended or adjusted under 35 U.S.C. 154(b) by 0 days.

(21) Appl. No.: 15/597,097

(22) Filed: May 16, 2017

(51) Int. Cl.
*G07D 11/00* (2006.01)
*E05G 1/02* (2006.01)

(52) U.S. Cl.
CPC ..... *G07D 11/0093* (2013.01); *E05G 1/02* (2013.01)

(58) Field of Classification Search
CPC ..... G07D 11/0093; G07D 11/0009; G07D 11/0015; E05G 1/02; E05G 1/026; E05G 5/02; G07F 9/06; G07B 15/066; A47G 29/124; A47G 29/20
USPC ..... 232/4 R, 15, 16, 63, 44, 55, 7, 12; 109/3, 66; 206/0.815; 194/350
See application file for complete search history.

(56) References Cited

U.S. PATENT DOCUMENTS

RE4,850 E * 4/1872 Slawson ..... 232/44
134,321 A 12/1872 Slawson
285,742 A 9/1883 Fowler
325,348 A 9/1885 Willis
333,233 A 12/1885 Willis
343,120 A 6/1886 Friede et al.
859,801 A 7/1907 Cassot
1,035,393 A * 8/1912 Smith, Jr. ..... G07F 9/06 232/54
1,105,620 A * 8/1914 Cook ..... G07F 9/06 232/15
1,365,818 A * 1/1921 Cox ..... G07F 9/06 232/62
1,793,466 A * 2/1931 Cox ..... E05G 1/02 232/7
2,119,592 A * 6/1938 McDonald ..... G07B 15/066 116/319
2,146,974 A * 2/1939 Brickman ..... G07B 15/066 232/15
2,303,985 A * 12/1942 Carter ..... G07B 15/066 232/12
2,990,113 A * 6/1961 Fosbrink ..... G07F 9/06 232/44

* cited by examiner

*Primary Examiner* — William Miller
(74) *Attorney, Agent, or Firm* — Ancel W. Lewis, Jr.; Cochran Freund & Young LLC

(57) ABSTRACT

A fee collection device has a tube, a chamber in the tube, a bonnet that covers and locks the top of the tube, and a collection bag that attaches to the bottom of the chamber. The tube is mounted vertically in the ground. The chamber is removable from the tube. The chamber has three vertically spaced, angled plates with serrated lower edges projecting inwardly alternately from the front and back of the chamber. The lower two angled plates are hinged. The chamber has support arms that allow the chamber to rest above the tube while the collection bag is emptied. The bonnet locks with a puck lock.

12 Claims, 4 Drawing Sheets

FISH PROOF FEE COLLECTION DEVICE

TECHNICAL FIELD

The present invention relates to fee collection, and more particularly to an unmanned fish proof fee collection device.

BACKGROUND ART

Campgrounds, picnic areas and parking areas in remote areas often use unmanned collection devices for fee collection. Generally, a user puts the fee into a provided envelope, writes identifying information on the envelope, such as a site number or a license plate number, and pushes the envelope through a fee slot in such fee collection devices. Prior known fee collection devices have several vulnerabilities and problems.

Thieves will attempt to fish envelopes back out of the fee collection device through the fee slot. Some prior known fee collection devices include a downwardly angled plate with a serrated lower edge to prevent such fishing. With fee collection devices with a single plate with a serrated lower edge, thieves are often able to push the line away from the serrated edge and successfully fish envelopes out. U.S. Pat. No. 134,321 to Slawson discloses a fare-box for use in street-cars, omnibuses, and other public conveyances with several plates with serrated lower edges.

Some prior known fee collection devices have small fee slots to inhibit fishing. Such small fee slots do not allow the use of coin packed envelopes. Other fee collection devices are locked with padlocks with shackles that are vulnerable to bolt cutters.

Some prior known fee collection devices have an interior that is only accessible through the top of the device. Accessing envelopes for collection and cleaning the interior is difficult in these devices. Other prior known fee collection devices have an access door lower on the device for envelope collection. These lower access doors can compromise the device strength and provide a point of vulnerability to thieves.

DISCLOSURE OF THE INVENTION

A fee collection device includes an elongated, hollow, vertical tube, a chamber, a bonnet and a collection bag. The tube has an open top end, a front wall and a fee chute in the front wall. The chamber slides into the tube through the top end. The chamber has a front, a spaced back, an upper end and a spaced lower end with the upper end aligning with the top end of the tube. The chamber has a first plate that projects downwardly, rearwardly from the front, below the fee chute, a second plate that projects downwardly, forwardly from the back, below the first plate, and a third plate that projects downwardly, rearwardly from the front, below the second plate. The first, second and third plates each have a serrated lower edge, and the second and third plates are mounted to rotate about the upper edges through selected angles. The bonnet is rotatably mounted to the front wall at the top end of the tube to move between an open position and a closed position. The bonnet covers the top end of the tube and a puck lock rigidly mounted to the bonnet locks the bonnet when in the closed position. The collection bag has an open top end that attaches to the lower end of the chamber and a spaced, closed bottom end.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
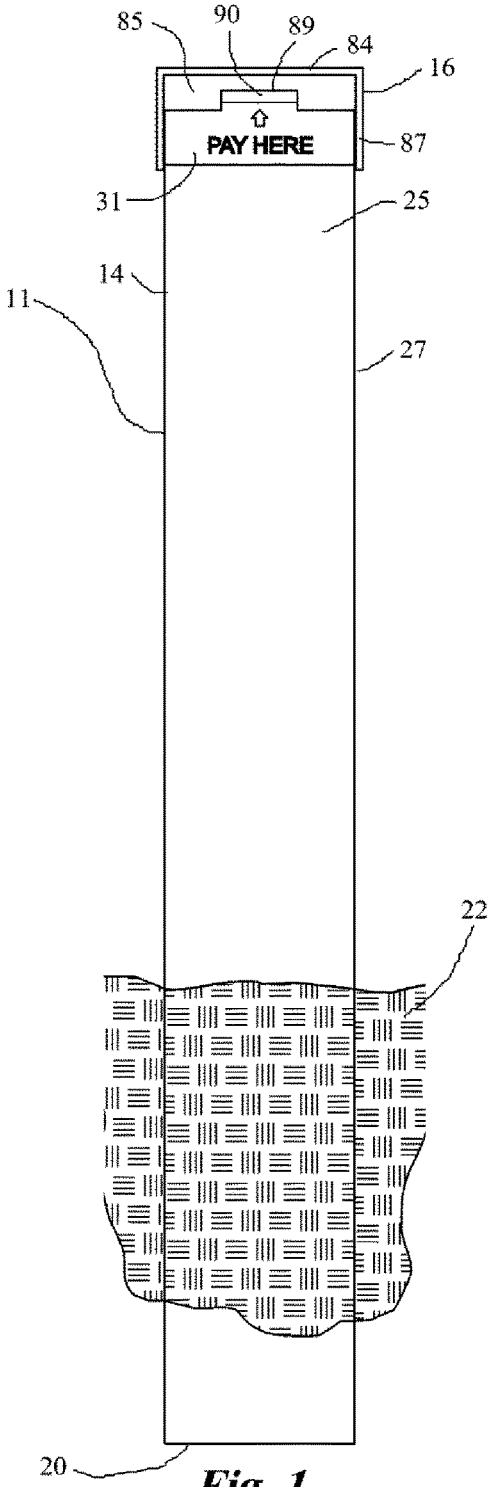
FIG. 1 is a front elevation view of a fee collection device embodying features of the present invention.
Figure 2:
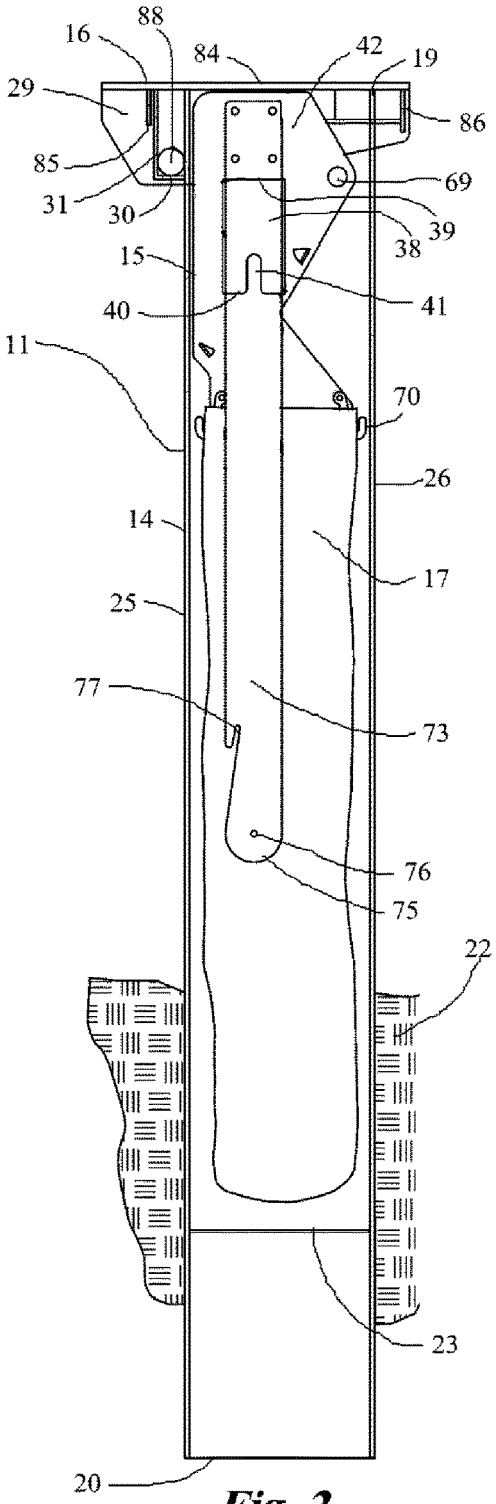
FIG. 2 is a side elevation view of the fee collection device of FIG. 1, with the tube side wall and bonnet side plate removed.
Figure 3:
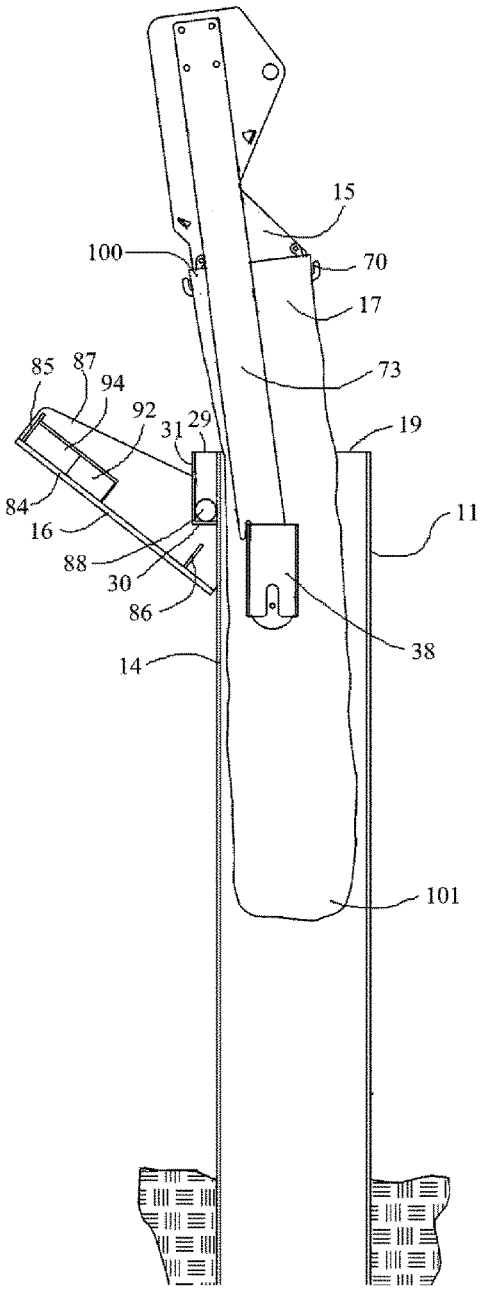
FIG. 3 is a side elevation view the fee collection device of FIG. 1, with the tube side wall and bonnet side plate removed, and the chamber raised out of the tube.
Figure 4:
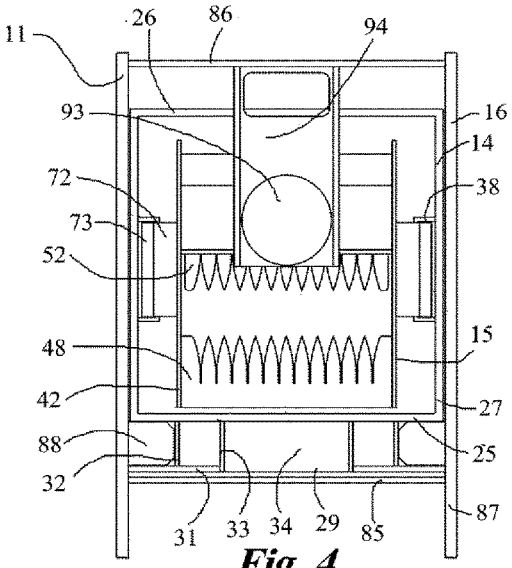
FIG. 4 is a top view of the fee collection device of FIG. 1, with the bonnet top plate removed.
Figure 5:
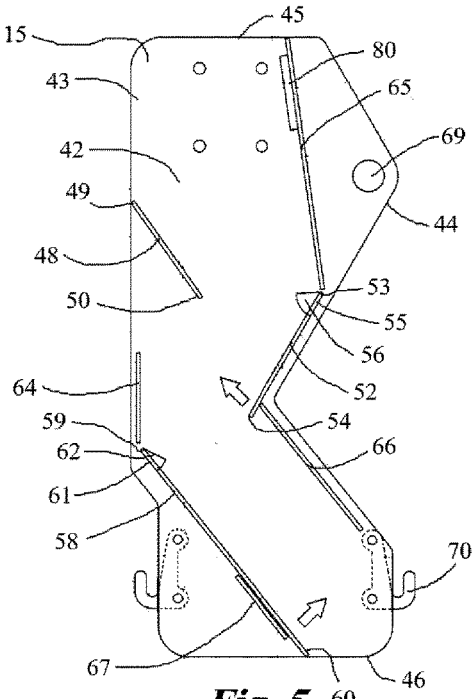
FIG. 5 is a side elevation view of the chamber of the fee collection device of FIG. 1 with the side plate removed.
Figure 6:
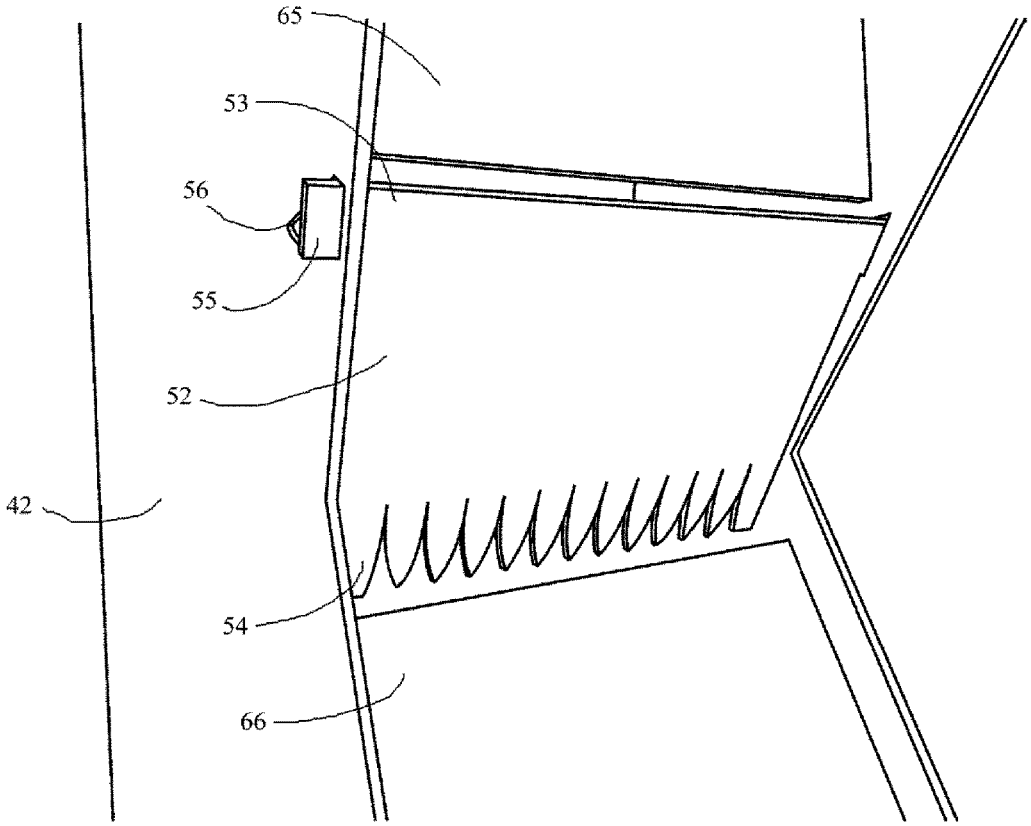
FIG. 6 is a partial perspective view of the chamber of the fee collection device of FIG. 1.
Figure 7:
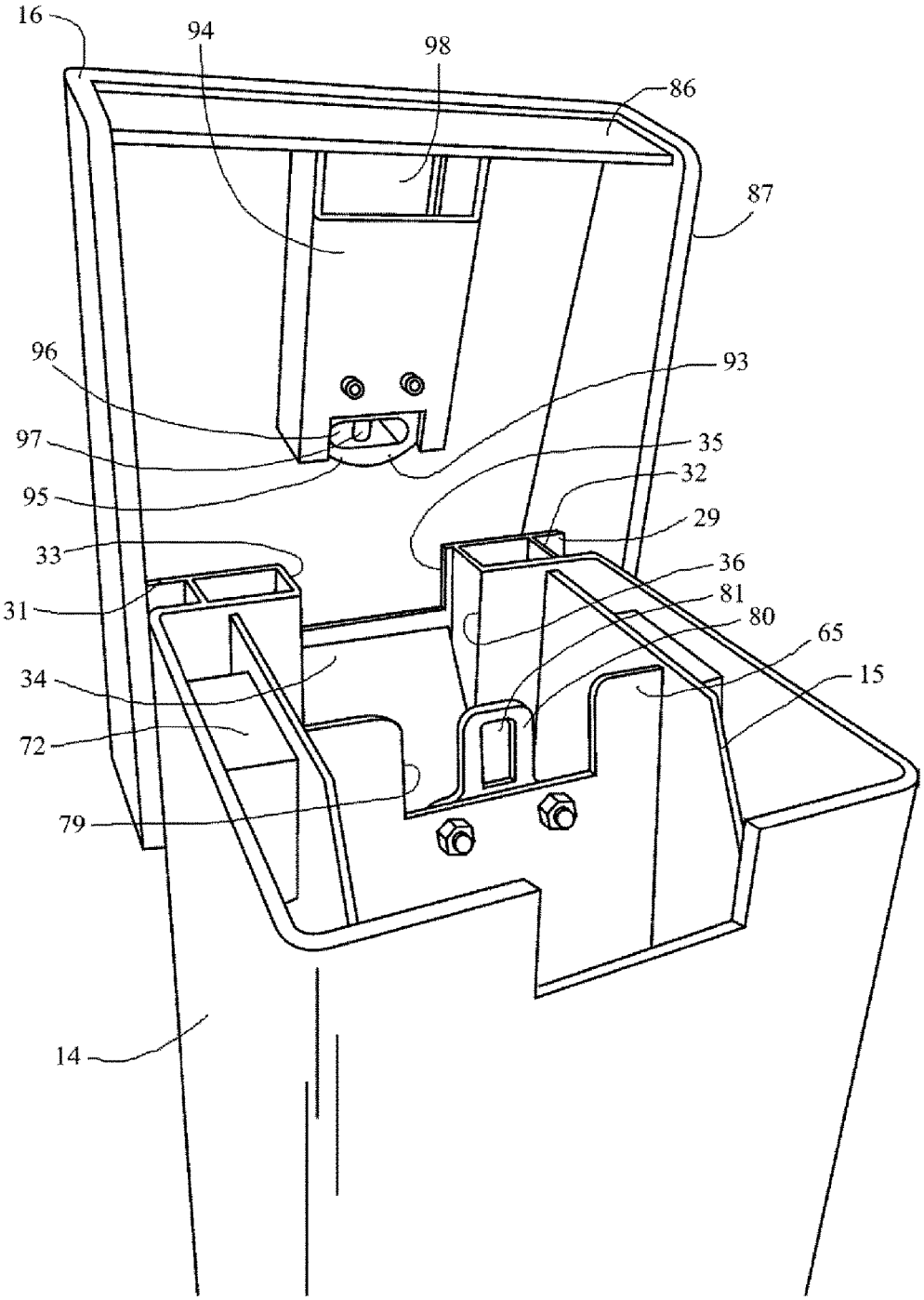
FIG. 7 is a partial perspective view of the fee collection device of FIG. 1, with the bonnet in the open position.

Referring to FIGS. 1 to 7, a fee collection device 11, embodying features of the present invention, includes a tube 14, a chamber 15, a bonnet 16 and a collection bag 17. The tube 14 is elongated and hollow with an open top end 19 and a spaced bottom end 20. The tube 14 is mounted vertically. The tube 14 shown is mounted in the ground and set in concrete 22. Alternatively, the tube 14 could be mounted on a base that is then attached to a horizontal surface.

The bottom of the tube 14 is sealed with a floor plate 23 near the bottom end 20. The tube 14 is preferably rectangular with a front wall 25, a spaced back wall 26 and a pair of spaced side walls 27 that extend from the front wall 25 to the back wall 26. More preferably, the tube 14 is heavy steel square tubing.

The tube 14 has a fee chute 29 mounted to the front wall 25 at the top end 19. The fee chute 29 includes a bottom plate 30, a front plate 31, a pair of outer side plates 32, a pair of inner side plates 33 and a fee plate 34. The bottom plate projects forwardly from the front wall 25 below the top end 19. The front plate 31 extends upwardly from the forward edge of the bottom plate 30 to the level of the top end 19 of the tube 14 and laterally the width of the front wall 25 of the tube 14. The outer side plates 32 extend forwardly from the front wall 25 of the tube 14 to the front plate 31 and upwardly from the bottom plate 30 to the level of the top end 19 of the tube 14, and are spaced laterally inwardly a selected distance relative to the side walls 27 of the tube 14. The inner side plates 33 extend forwardly from the front wall 25 of the tube 14 to the front plate 31 and upwardly from the bottom plate 30 to the level of the top end 19 of the tube 14, and are spaced laterally inwardly a selected distance from the outer side plates 32.

The front plate 31 of the fee chute 29 has a rectangular chute notch 35 that extends laterally from one inner side plate 33 to the other inner side plate 33, and downwardly a selected depth from the top of the front plate 31. The front wall 25 of the tube has a rectangular tube notch 36 that extends laterally from one inner side plate 33 to the other inner side plate 33, and downwardly from the top end 19 of the tube 14 a selected depth that is greater than the depth of the chute notch 35. The fee plate 34 is the same width as the chute notch 35 and the tube notch 36, and extends downwardly, rearwardly from the bottom of the chute notch 35 to the bottom of the tube notch 36.

The tube 14 includes a pair of retaining plates 37. The retaining plates 37 have a flattened C shape. Each retaining plate 37 is mounted to one of the side walls 27 of the tube 14, intermediate the front wall 25 and the back wall 26, and spaced a selected distance below the top end 19 of the tube 14. The retaining plates 37 each have a top edge 38, a spaced bottom edge 39 and retaining plate notch 40 that extends upwardly from the bottom edge 39 of the retaining plate 37.

The chamber 15 is sized and shaped to slide into the tube 14 through the top end 19. The chamber 15 has a pair of laterally spaced side plates 42 that define a front 43, a back 44, an upper end 45 and a lower end 46 of the chamber 15. The upper end 45 of the chamber 15 aligns with the top end 19 of the tube 14.

The chamber 15 includes a first plate 48 with an upper edge 49 and a spaced, serrated lower edge 50. The first plate 48 extends laterally from one side plate 42 to the other side plate 42, and projects downwardly, rearwardly from the front 43. The upper edge 49 is positioned below the tube notch 36.

The chamber 15 has a second plate 52 with an upper edge 53 and a spaced, serrated lower edge 54. The second plate 52 is spaced below the first plate 48, extends laterally from one side plate 42 to the other side plate 42, and projects downwardly, forwardly from the back 44. A rectangular tab 55 projects from each side edge of the second plate 52 at the upper edge 53, and each side plate 42 has a plate aperture 56 that has the shape of a portion of a circle. The plate apertures 56 are sized and positioned to receive the tabs 55 and allow the second plate 52 to rotate about the upper edge 53 through a selected angle.

The chamber 15 includes a third plate 58, spaced below the second plate 52, and having an upper edge 59 and a spaced, serrated lower edge 60. The second plate 52 extends laterally from one side plate 42 to the other side plate 42, and projects downwardly, rearwardly from the front 43 with the lower edge 60 of the third plate 58, extending rearwardly of the lower edge 54 of the second plate 52. A rectangular tab 61 projects from each side edge of the third plate 58 at the upper edge 59, and each side plate 42 has a plate aperture 62 that has the shape of a portion of a circle. The plate apertures 62 are sized and positioned to receive the tabs 61 and allow the third plate 58 to rotate about the upper edge 59 through a selected angle.

The side plates 42 of the chamber 15 shown are connected together by a front plate 64, an upper back plate 65, a lower back plate 66 and a bottom plate 67. The front plate 64 is spaced below the upper edge 49 of the first plate 48 and extends downwardly to the upper edge 59 of the third plate 58 at the front 43 of the chamber 15. The upper back plate 65 is spaced inwardly from the back 44 of the chamber 15, extends from the upper end 45 downwardly to the upper edge 53 of the second plate 52, and angles slightly rearwardly. The lower back plate 66 extends downwardly, rearwardly from the lower edge 54 of the second plate 52 and supports the lower edge 54 of the second plate 52. The bottom plate 67 is positioned parallel to and below the third plate 58 and supports the third plate 58.

A cylindrical handle 69 connects between the side plates 42 of the chamber 15, behind the upper back plate 65, for lifting the chamber 15. Hooks 70 are attached to each side plate 42 at the front 43 and the back 44 of the chamber 15, near the lower end 46.

A spacer block 72 is mounted to the outside of each side plate 42 near the upper end 45 of the chamber. An elongated support arm 73 is attached to the outside of and extends downwardly from each spacer block 72. The support arms 73 are sized and shaped to fit into and slide in the retaining plates 38 of the tube 14. Preferably the support arms 73 are metal strap. The spacer blocks 72 rest on top edge 38 of the retaining plates 38 and are positioned such that the upper end 45 of the chamber 15 aligns with the top end 19 of the tube 14.

The support arms 73 extend downwardly a selected distance below the lower end 46 of the chamber 15 to a rounded bottom end 75. A stop pin 76 projects laterally outwardly from each support arm 73 near the bottom end 75. The stop pins 76 are sized to fit into the retaining plate notches 41. The support arms 73 allow the lower end 46 of the chamber 15 to be lifted above the top end 19 of the tube 14 while the stop pins 76 prevent complete removal of the chamber 15 from the fee collection device 11.

The support arms 73 each have an angled support notch 77 spaced above the stop pin 76 and extending upwardly, inwardly. The support notches 77 are sized to receive the top edges 39 of the retaining plates 38. The support notches 77 allow a user to rest the chamber 15 above the tube 14.

The top of the upper back plate 65 of the chamber 15 has a downwardly extending, rectangular staple notch 79. A lock staple 80 mounts on the upper back plate 65 and projects upwardly into the staple notch 79. A plunger aperture 81 extends through the lock staple 80.

The bonnet 16 rotatably mounts to top end 19 of the tube 14 to move between an open position and a closed position. The bonnet 16 has a top plate 84, a front plate 85, a back plate 86 and a pair of spaced side plates 87. The top plate 84 covers the top end 19 of the tube 14 when the bonnet 16 is in the closed position. The front plate 85, back plate 86 and side plates 87 project downwardly from the top plate 84, outside of the front wall 25, back wall 26 and side walls 27 of the tube 14 when the bonnet 16 is in the closed position. Hinge pins 88 project inwardly from each side plate 87 into the outer side plates 32 of the fee chute 29 to rotatably mount the bonnet 16 to top end 19 of the tube 14. The front plate 85 has an upwardly extending, rectangular fee notch 89 that aligns with the chute notch 35 to define a fee slot 90 for users to insert fees into the fee collection device 11.

The bonnet 16 includes a means for locking 92 the bonnet 16 in the closed position. The means for locking 92 shown includes a puck lock 93 and a channel 94 attached to bottom of the top plate 84. The channel 94 is sized and shaped to receive the puck lock 93 and attach the puck lock 93 to the top plate 84. The puck lock 93 has puck shaped body 95 with a slot 96 that extends through the body 95, and a plunger 97 that extends across the slot 96 when the puck lock 93 is locked.

The puck lock 93 is positioned under the top plate 84 such that when the bonnet 16 is closed, the lock staple 80 projects into the slot 96, and when the puck lock 93 is locked, the plunger 97 extends through the plunger aperture 81 of the lock staple 80. A rectangular key aperture 98 through the top plate 84 extends forwardly from the back plate 86 for accessing the puck lock 93 with a key.

The collection bag 17 has an open top end 100 and a spaced, closed bottom end 101. The top end 100 is sized to fit around the lower end 46 of the chamber 15 and is removably attached to the chamber 15 by the hooks 70. The collection bag 17 is preferably made of canvas or other sturdy fabric.

The serrated lower edges 50, 54 and 60 of the first, second and third plates 48, 52 and 54 of the chamber 15 prevent fishing fees out of the fee collection device 11. The rotatable mounting of the second and third plates 52 and 54 of the chamber 15 enhances the fishing prevention. The use of the puck lock 93 to lock the bonnet 16 eliminates any lock shackle that would be vulnerable to bolt cutters.

The removable chamber 15 and collection bag 17, in combination with the support arms 73, allow easy fee collection and tube cleaning. The removable chamber 15 and collection bag 17 also eliminate the need for a lower access door that could compromise the device strength and provide a point of vulnerability to thieves.

Although the present invention has been described with a certain degree of particularity, it is understood that the present disclosure has been made by way of example and that changes in details of structure may be made without departing from the spirit thereof.

What is claimed is:

1. A fee collection device comprising:

an elongated, hollow, vertical tube having an open top end, a spaced bottom end, a front wall and a fee chute extending through said front wall at said top end, a chamber sized and shaped to be slidably received into said tube through said top end of said tube, said chamber having a front, a spaced back, an upper end and a spaced lower end with said upper end substantially aligning with said top end of said tube when said chamber is in said tube, said chamber having a first plate that projects downwardly, rearwardly from said front, below said fee chute, a second plate that projects downwardly, forwardly from said back, below said first plate, and a third plate that projects downwardly, rearwardly from said front, below said second plate, said first, second and third plates each having a serrated lower edge, a bonnet movable between an open position wherein said top end of said tube is open to receive said chamber and a closed position wherein said bonnet covers said top end of said tube, said bonnet including means for locking said bonnet in said closed position, and a collection bag having an open top end that removably attaches to said lower end of said chamber and a spaced, closed bottom end, whereby fees inserted into said fee chute fall through said chamber and into said collection bag while said lower edges of said first, second and third plates prevent fishing said fee from said collection bag.

2. The fee collection device as set forth in claim 1 wherein said second and third plates have upper edges and are mounted to rotate about said upper edges through selected angles to provide additional fishing prevention.

3. The fee collection device as set forth in claim 1 wherein said tube is a rectangular tube with a back wall spaced from said front wall and a pair of spaced side walls that extend from said front wall to said back wall.

4. The fee collection device as set forth in claim 3 wherein said bonnet is rotatably mounted to said front wall at said top end of said tube to move between said open position and said closed position, and has a top plate that covers said top end of said tube, a front plate, a back plate and a pair of spaced side plates that each project downwardly from said top plate outside of said front wall, said back wall and said side walls, respectively, when said bonnet is in said closed position.

5. The fee collection device as set forth in claim 4 wherein said means for locking includes a puck lock rigidly mounted to said bonnet beneath said top plate.

6. The fee collection device as set forth in claim 5 wherein said puck lock includes a slot and a plunger that projects through said slot when said puck lock is locked, and said chamber includes a lock staple that projects upwardly at said upper end, said lock staple being positioned to project into said slot when said bonnet is in said closed position, said lock staple including a plunger aperture sized and positioned to receive said plunger.

7. The fee collection device as set forth in claim 3 wherein:

said chamber includes a pair of spaced side plates extending from said upper end to said lower end, with said first, second and third plates mounted between said side plates, and a pair of elongated support arms with one said support arm being mounted outwardly from each side plate, said support arms extending vertically from said upper end to a selected distance below said lower end, and said tube includes a C shaped retaining plate mounted on each said side wall and spaced a selected distance below said top end, said retaining plates being sized and shaped to slidably receive and to retain said support arms, whereby said support arms slide in said retaining plates to guide said chamber in and out of said tube.

8. The fee collection device as set forth in claim 7 wherein each said retaining plate has a top edge and a spaced bottom edge, and said chamber includes a spacer block between each said side plate and support arm with said spacer blocks being sized and positioned to rest on said top edges of said retaining plates to support said chamber and to align said upper end of said chamber with said top end of said tube.

9. The fee collection device as set forth in claim 8 wherein said support arms each extend below said bottom edges of said retaining plates to a bottom end, said support arms each having a stop pin spaced a selected distance above said bottom end that stops upward travel of said chamber when said stop pins contact said bottom edges of said retaining plates, said stop pins being positioned such that said top end of said collection bag is spaced above said top end of said tube to allow easy removal and replacement of said collection bag.

10. The fee collection device as set forth in claim 9 wherein said support arms each have an upwardly, inwardly angled support notch spaced above said stop pin and sized to receive said top edge of said retaining plate to allow said retaining plates to support said chamber during removal and replacement of said collection bag.

11. The fee collection device as set forth in claim 9 wherein said chamber includes a handle that extends between said side plates at said back near said upper end for lifting said chamber out of said tube.

12. A fee collection device comprising:

an elongated, hollow, vertical tube having an open top end, a spaced bottom end, a front wall and a fee chute extending through said front wall at said top end, a chamber sized and shaped to be slidably received into said tube through said top end of said tube, said chamber having a front, a spaced back, an upper end and a spaced lower end with said upper end substantially aligning with said top end of said tube when said chamber is in said tube, said chamber having a first plate that projects downwardly, rearwardly from said front, below said fee chute, a second plate that projects downwardly, forwardly from said back, below said first plate, and a third plate that projects downwardly, rearwardly from said front, below said second plate, said first, second and third plates each having a serrated lower edge, said second and third plates having upper edges and being mounted to rotate about said upper edges through selected angles, said chamber including a lock staple that projects upwardly at said upper end, said lock staple including a plunger aperture, a bonnet rotatably mounted to said front wall at said top end of said tube to move between an open position wherein said top end of said tube is open to receive said chamber and a closed position wherein said bonnet covers said top end of said tube, said bonnet having a top plate that covers said top end of said tube, a front plate, a back plate and a pair of spaced side plates that each project downwardly from said top plate outside of said front wall, said back wall and said side walls, respectively, when said bonnet is in said closed position, said bonnet having a puck lock rigidly mounted to said bonnet beneath said top plate, said puck lock including a slot and a plunger that projects through said slot when said puck lock is locked, said slot being positioned to receive said lock staple when said bonnet is in said closed position, said plunger being sized and positioned to extend through said plunger aperture, and a collection bag having an open top end that removably attaches to said lower end of said chamber and a spaced, closed bottom end, whereby fees inserted into said fee chute fall through said chamber and into said collection bag while said lower edges of said first, second and third plates prevent fishing said fee from said collection bag.

* * * * *